US005927933A

United States Patent [19]

Tucker

[11] Patent Number: 5,927,933

[45] Date of Patent: Jul. 27, 1999

[54] RETRACTABLE THUMB

[76] Inventor: William C. Tucker, P.O. Box 5420, Wakefield, R.I. 02880

[21] Appl. No.: 09/031,466

[22] Filed: Feb. 26, 1998

[51] Int. Cl.[6] ..... E02F 3/76

[52] U.S. Cl. ..... 414/729; 37/403; 37/406; 414/724

[58] Field of Search ..... 414/729, 724, 414/722, 912; 37/403, 405, 406

[56] References Cited

U.S. PATENT DOCUMENTS 4,375,345 3/1983 Hanson ..... 414/729 X 4,403,906 9/1983 Holopainen ..... 414/724

5,678,332 10/1997 Hawkins ..... 414/722 X

*Primary Examiner*—Donald W. Underwood

[57] ABSTRACT

A retractable thumb for a bucket is provided including a bucket assembly which has a bucket arm with an inboard portion and an outboard portion. Next provided is a thumb including an inboard edge pivotally coupled to the outboard portion of the bucket arm. A hydraulic assembly includes a first hydraulic arm for moving the bucket and a second hydraulic arm for moving the thumb. Finally, a recess is formed in the outboard portion of the bucket arm for accepting the thumb therein for storage purposes.

7 Claims, 2 Drawing Sheets

RETRACTABLE THUMB

BACKGROUND OF THE INVENTION

1. Field of the Invention

The present invention relates to buckets and more particularly pertains to a new retractable thumb for providing a thumb attached to a bucket which is capable of being retracted in a stored position when not in use.

2. Description of the Prior Art

The use of buckets is known in the prior art. More specifically, buckets heretofore devised and utilized are known to consist basically of familiar, expected and obvious structural configurations, notwithstanding the myriad of designs encompassed by the crowded prior art which have been developed for the fulfillment of countless objectives and requirements.

Known prior art buckets include U.S. Pat. No. 4,932,832; U.S. Pat. No. 4,375,345; U.S. Pat. No. 4,858,346; U.S. Pat. No. 3,061,123; U.S. Pat. No. 2,044,624; and Foreign EP 0 325 358 A1 and EP 0 411 486 A1.

In these respects, the retractable thumb according to the present invention substantially departs from the conventional concepts and designs of the prior art, and in so doing provides an apparatus primarily developed for the purpose of providing a thumb attached to a bucket which is capable of being retracted in a stored position when not in use.

SUMMARY OF THE INVENTION

In view of the foregoing disadvantages inherent in the known types of buckets now present in the prior art, the present invention provides a new retractable thumb construction wherein the same can be utilized for providing a thumb attached to a bucket which is capable of being retracted in a stored position when not in use.

The general purpose of the present invention, which will be described subsequently in greater detail, is to provide a new retractable thumb apparatus and method which has many of the advantages of the buckets mentioned heretofore and many novel features that result in a new retractable thumb which is not anticipated, rendered obvious, suggested, or even implied by any of the prior art buckets, either alone or in any combination thereof.

To attain this, the present invention generally comprises a bucket assembly having a bucket arm with an inboard portion and an outboard portion. The inboard portion is equipped with a first end pivotally coupled to a vehicle. The outboard portion of the bucket arm has a first end pivotally coupled to a second end of the inboard portion. The bucket assembly further includes a bucket with a bottom face defined by a portion of a cylinder and a pair of semi-circular side faces coupled to the bottom face for defining a square upper peripheral edge. An inboard edge of the upper peripheral edge of the bucket is hingably coupled to a second end of the outboard portion of the bucket arm. Next provided is a thumb with a planar rectangular configuration. A periphery of the thumb is defined by a pair of elongated parallel side edges each with a length equal to that of the bucket and a pair of short parallel end edges each with a width equal to less than ⅓ that of the bucket. The thumb further includes a rectangular lip coupled to an outboard end edge of the thumb and extended therefrom in perpendicular relationship therewith. As shown in FIG. 2, the lip preferably extends a distance less than ¼ that of the thumb. An inboard edge of the thumb is pivotally coupled to the outboard portion of the bucket arm adjacent to the second end thereof. Finally, a hydraulic assembly is provided including a first hydraulic arm having a first end coupled to a central extent of a top surface of the outboard portion of the bucket arm. A first connector of a first length having a first end pivotally coupled to the outboard portion of the bucket arm adjacent to the second end thereof. A second end of the first connector is pivotally coupled to a second end of the first hydraulic arm. Associated therewith is a pair of parallel second connectors each of a second length greater than the first length. The second connectors each have a first end pivotally connected to the second end of the first hydraulic arm. The second connectors further have a second end pivotally connected to an outer surface of the bottom face of the bucket. The hydraulic assembly also includes a second hydraulic arm having a first end coupled to a central extent of a bottom surface of the outboard portion of the bucket arm. A second end of the second hydraulic arm is pivotally connected to a central extent of a top surface of the thumb. As shown in FIG. 4, an elongated recess is formed in the bottom surface of the outboard portion of the bucket arm for accepting the thumb and associated hydraulic arm therein for storage purposes.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new retractable thumb apparatus and method which has many of the advantages of the buckets mentioned heretofore and many novel features that result in a new retractable thumb which is not anticipated, rendered obvious, suggested, or even implied by any of the prior art buckets, either alone or in any combination thereof.

It is another object of the present invention to provide a new retractable thumb which may be easily and efficiently manufactured and marketed.

It is a further object of the present invention to provide a new retractable thumb which is of a durable and reliable construction.

An even further object of the present invention is to provide a new retractable thumb which is susceptible of a low cost of manufacture with regard to both materials and labor, and which accordingly is then susceptible of low prices of sale to the consuming public, thereby making such retractable thumb economically available to the buying public.

Still yet another object of the present invention is to provide a new retractable thumb which provides in the apparatuses and methods of the prior art some of the advantages thereof, while simultaneously overcoming some of the disadvantages normally associated therewith.

Still another object of the present invention is to provide a new retractable thumb for providing a thumb attached to a bucket which is capable of being retracted in a stored position when not in use.

Even still another object of the present invention is to provide a new retractable thumb that includes a bucket assembly which has a bucket arm with an inboard portion and an outboard portion. Next provided is a thumb including an inboard edge pivotally coupled to the outboard portion of the bucket arm. A hydraulic assembly includes a first hydraulic arm for moving the bucket and a second hydraulic arm for moving the thumb. Finally, a recess is formed in the outboard portion of the bucket arm for accepting the thumb therein for storage purposes.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
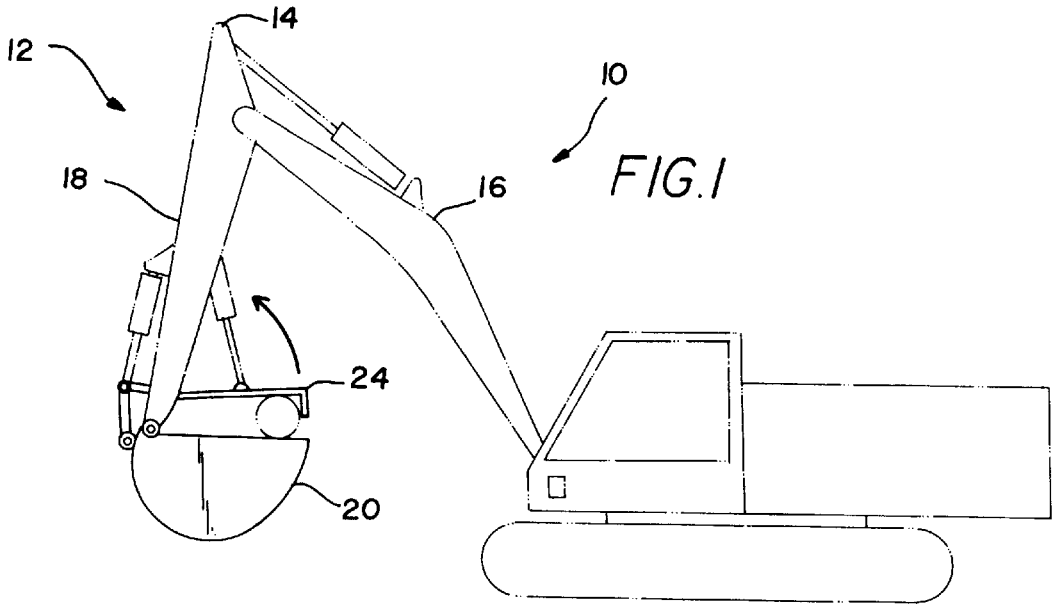
FIG. 1 is a side view of a new retractable thumb according to the present invention.

With reference now to the drawings, and in particular to FIGS. 1 through 4 thereof, a new retractable thumb embodying the principles and concepts of the present invention and generally designated by the reference numeral 10 will be described.

The present invention, designated as numeral 10, includes a bucket assembly 12 having a bucket arm 14 with an inboard portion 16 and an outboard portion 18. The inboard portion is equipped with a first end pivotally coupled to a vehicle. The outboard portion of the bucket arm has a first end pivotally coupled to a second end of the inboard portion.

The bucket assembly further includes a bucket 20 with a bottom face defined by a portion of a cylinder and a pair of semi-circular planar side faces coupled to the bottom face for defining a square upper peripheral edge 22. An inboard edge of the upper peripheral edge of the bucket is hingably coupled to a second end of the outboard portion of the bucket arm.

Figure 2:
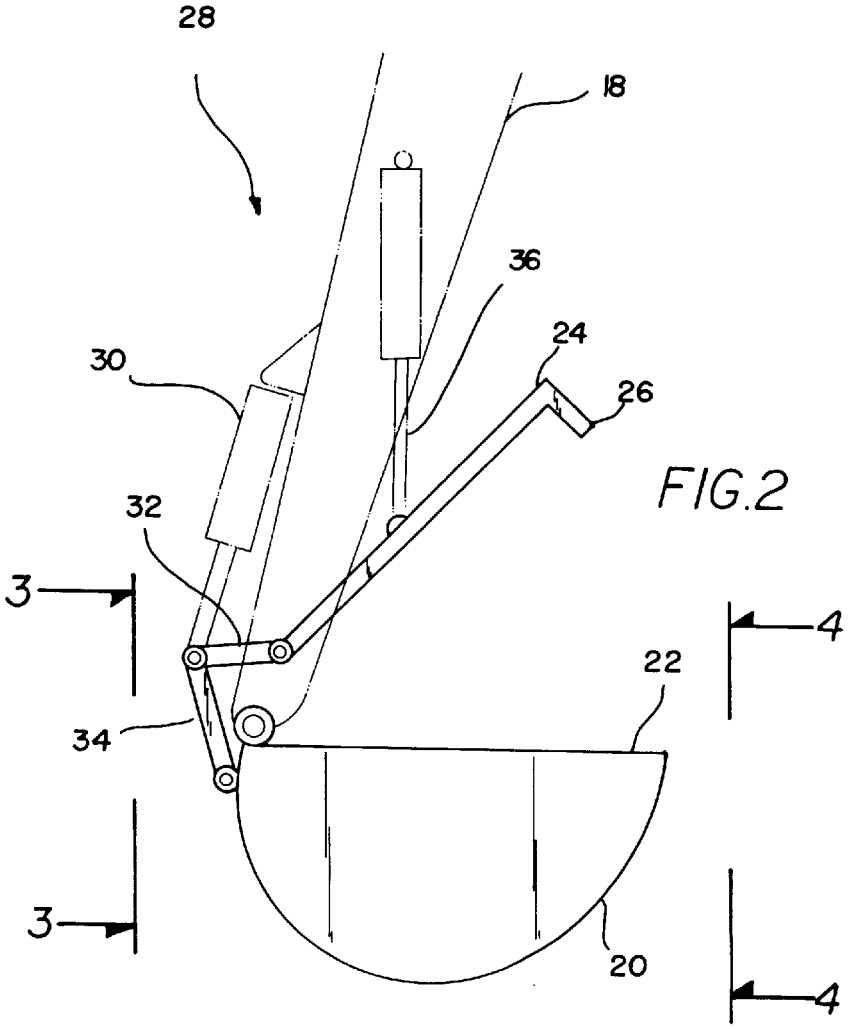
FIG. 2 is a close-up side view of the present invention.

Next provided is a thumb 24 with a planar rectangular configuration. A periphery of the thumb is defined by a pair of elongated parallel side edges each with a length equal to that of the bucket and a pair of short parallel end edges each with a width equal to less than ⅓ that of the bucket. The thumb further includes a rectangular lip 26 coupled to an outboard end edge of the thumb and extended downwardly therefrom in perpendicular relationship therewith. As shown in FIG. 2, the lip preferably extends a distance less than ¼ a length of the thumb. An inboard edge of the thumb is pivotally coupled to the outboard portion of the bucket arm adjacent to the second end thereof.

Finally, a hydraulic assembly 28 is provided including a first hydraulic arm 30 having a first end coupled to a central extent of a top surface of the outboard portion of the bucket arm. A first connector 32 is provided having a first end pivotally coupled to the outboard portion of the bucket arm adjacent to the second end thereof. The distance of the first end of the first connector and the second end of the outboard portion of the bucket arm is preferably equal to a first length of the first connector. A second end of the first connector is pivotally coupled to a second end of the first hydraulic arm.

Associated therewith is a pair of parallel second connectors 34 each of a second length greater than the first length. The second connectors each have a first end pivotally connected to the second end of the first hydraulic arm. The second connectors further have a second end pivotally connected to an outer surface of the bottom face of the bucket.

The hydraulic assembly also includes a second hydraulic arm 36 having a first end coupled to a central extent of a bottom surface of the outboard portion of the bucket arm. A second end of the second hydraulic arm is pivotally connected to a central extent of a top surface of the thumb.

Figure 3:
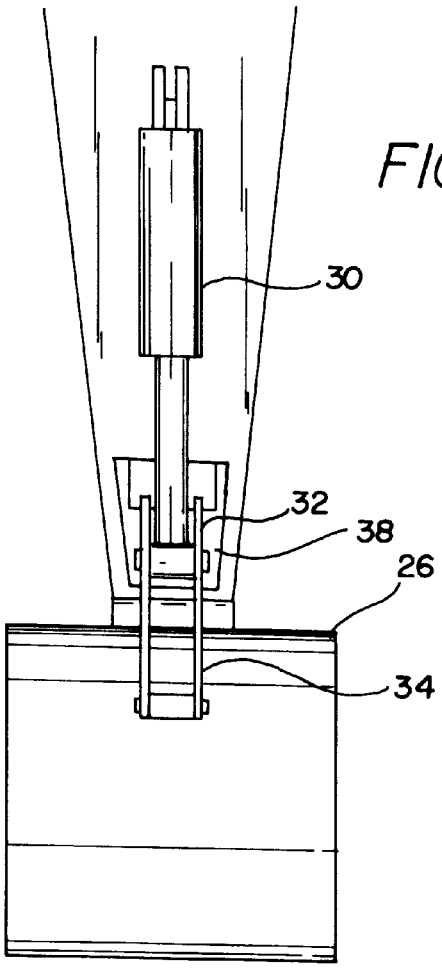
FIG. 3 is a first view of the bucket assembly of the present invention.
Figure 4:
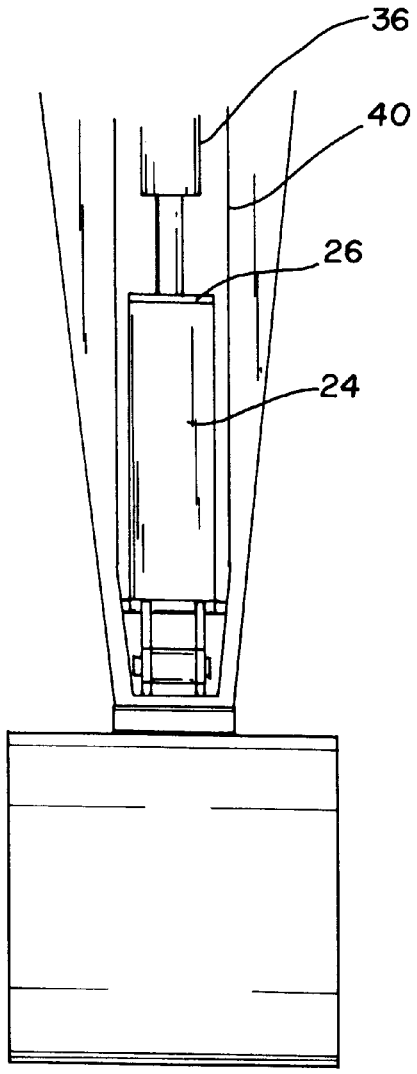
FIG. 4 is a second view of the bucket assembly of the present invention.

As shown in FIGS. 3 & 4, a pivot rod which interconnects the thumb and the first connector is preferably situated between side edges of a cut out 38 formed in the outboard portion of the bucket arm. Such cut out is further in communication with an elongated recess 40 formed in the bottom surface of the outboard portion of the bucket arm for accepting the thumb and associated hydraulic arm therein for storage purposes. The recess preferably extends between the cut out and the first end of the second hydraulic arm.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An apparatus comprising, in combination:

a bucket assembly including a bucket arm having an inboard portion with a first end pivotally coupleable to a vehicle and an outboard portion with a first end pivotally coupled to a second end of the inboard portion, the bucket assembly further including a bucket with a bottom face defined by a portion of a cylinder and a pair of semi-circular side faces coupled to the bottom face for defining a square upper peripheral edge, wherein an inboard edge of the upper peripheral edge of the bucket is hingably coupled to a second end of the outboard portion of the bucket arm;

a thumb with a planar rectangular configuration including a periphery defined by a pair of elongated parallel side edges each with a length equal to that of the bucket and a pair of short parallel end edges each with a width equal to less than ⅓ that of the bucket, the thumb further including a rectangular lip coupled to an outboard end edge of the thumb and extending therefrom a distance less than ¼ that of the thumb in perpendicular relationship therewith, wherein an inboard edge of the thumb is pivotally coupled to the outboard portion of the bucket arm adjacent to the second end thereof; and a hydraulic assembly including a first hydraulic arm having a first end coupled to a central extent of a top surface of the outboard portion of the bucket arm, a first connector of a first length having a first end pivotally coupled to the outboard portion of the bucket arm adjacent to the second end thereof and a second end pivotally coupled to a second end of the first hydraulic arm, a pair of parallel second connectors each of a second length greater than the first length with a first end pivotally connected to the second end of the first hydraulic arm and a second end pivotally connected to an outer surface of the bottom face of the bucket, and a second hydraulic arm having a first end coupled to a central extent of a bottom surface of the outboard portion of the bucket arm and a second end pivotally connected to a central extent of a top surface of the thumb;

wherein an elongated recess is formed in the bottom surface of the outboard portion of the bucket arm for accepting the thumb and associated hydraulic arm therein for storage purposes.

2. An apparatus comprising:

a bucket assembly including a bucket arm having an inboard portion with a first end pivotally coupleable to a vehicle and an outboard portion with a first end pivotally coupled to a second end of the inboard portion, the bucket assembly further including a bucket hingably coupled to a second end of the outboard portion of the bucket arm;

a thumb including an inboard edge pivotally coupled to the outboard portion of the bucket arm; and a hydraulic assembly including a first hydraulic arm connected between the bucket and the outboard portion for moving the bucket and a second hydraulic arm connected between the thumb and the outboard portion for moving the thumb;

wherein a recess is formed in the outboard portion of the bucket arm for accepting the thumb therein for storage purposes.

3. The apparatus as set forth in claim 2 wherein the thumb has a width equal to about ⅓ that of the bucket.

4. The apparatus as set forth in claim 2 wherein the thumb is centrally situated over the bucket.

5. The apparatus as set forth in claim 2 wherein the first hydraulic arm is connected to the bucket via a pair of connectors of different lengths.

6. The apparatus as set forth in claim 2 wherein the first hydraulic arm is mounted to a top surface of the outboard portion of the bucket arm.

7. The apparatus as set forth in claim 2 wherein the second hydraulic arm is mounted to a bottom surface of the outboard portion of the bucket arm.

* * * * *